United States Patent [19]

Fanning, Jr.

[11] 4,005,536

[45] Feb. 1, 1977

[54] CHANGEABLE DISPLAY APPARATUS

[75] Inventor: Samuel Plato Fanning, Jr., Jackson, Miss.

[73] Assignee: National Advertising Company, Bedford Park, Ill.

[22] Filed: Aug. 19, 1975

[21] Appl. No.: 605,803

[52] U.S. Cl. ..... 40/104.02; 40/72

[51] Int. Cl.$^2$ ..... G09F 11/02

[58] Field of Search ..... 40/5, 102, 104.02, 72

[56] References Cited

UNITED STATES PATENTS

| | | | |
|---|---|---|---|
| 1,326,832 | 12/1919 | Baily | 40/104.02 |
| 1,881,639 | 10/1932 | Johnson | 40/104.02 X |
| 3,455,044 | 7/1969 | Falconbridge et al. | 40/129 C |
| 3,673,718 | 7/1972 | Bernard | 40/5 |

*Primary Examiner*—Russell R. Kinsey
*Assistant Examiner*—Wenceslao J. Contreras
*Attorney, Agent, or Firm*—Merriam, Marshall, Shapiro & Klose

[57] ABSTRACT

A changeable display apparatus including segmented display character members hingedly supported on a frame, the hinges having flanges mounted to the display character members to enable the display character members to lie substantially flat against the frame in a display position, and latching means for clamping the display character members in the display position and for selectively unlatching and rotating desired display character members during display changes.

6 Claims, 9 Drawing Figures

FIG.1
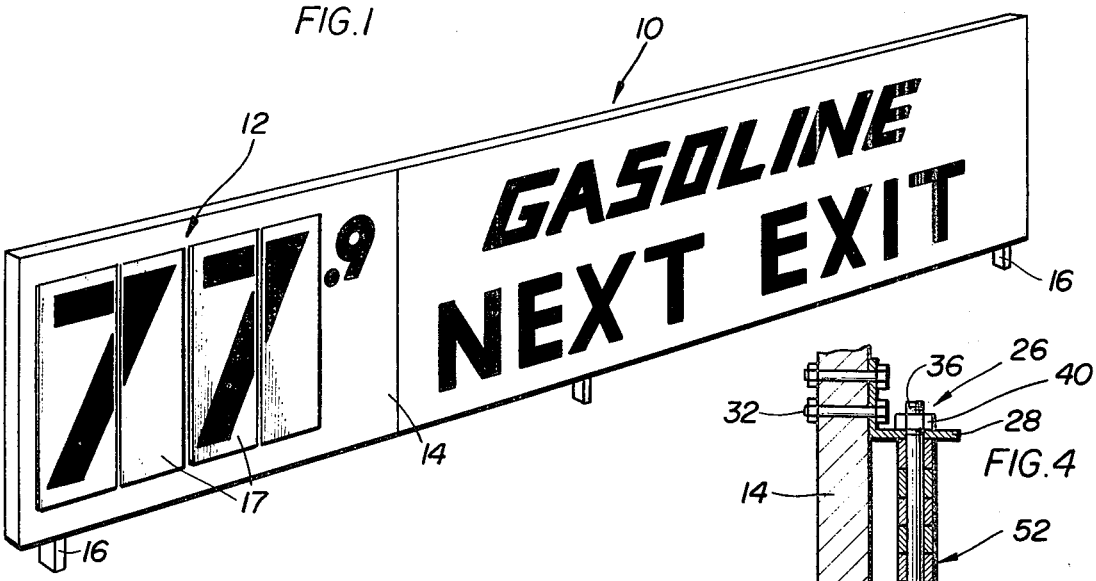
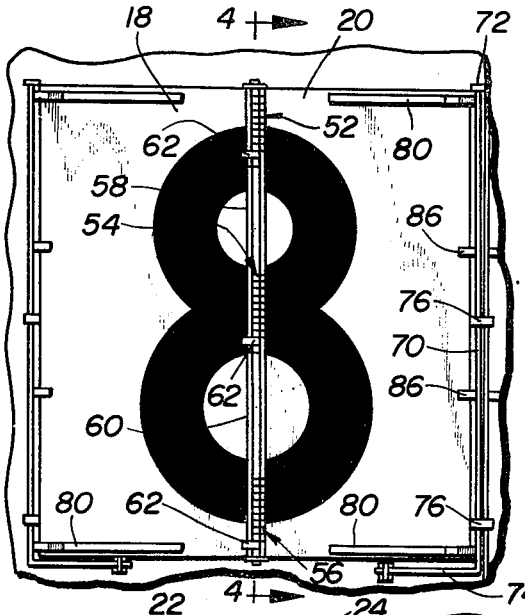
FIG.2
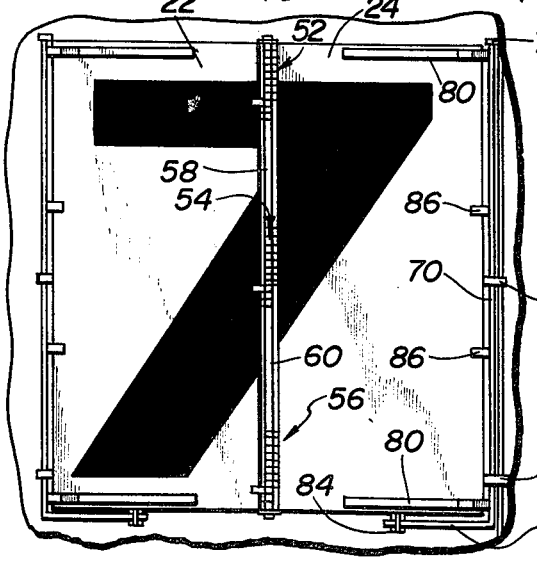
FIG.3
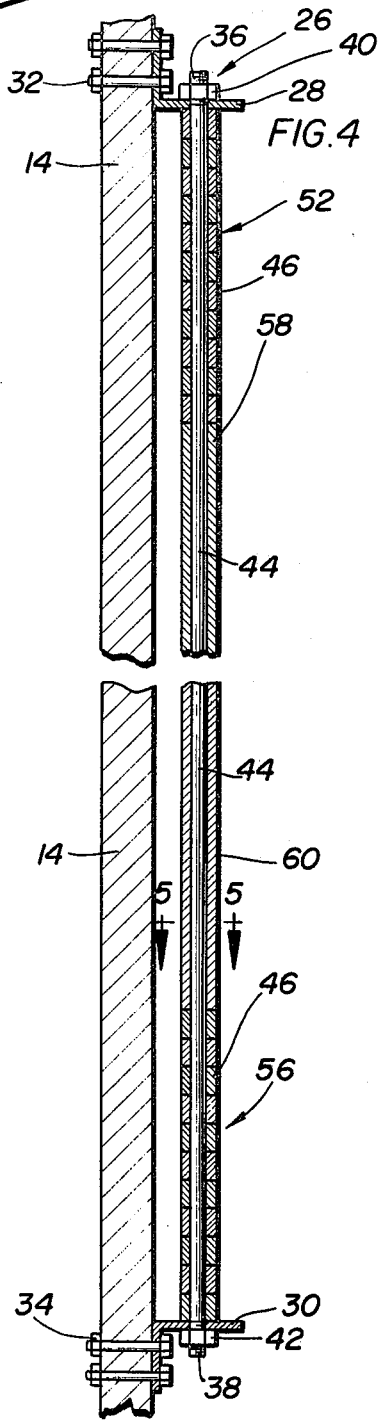
FIG.4

FIG.5
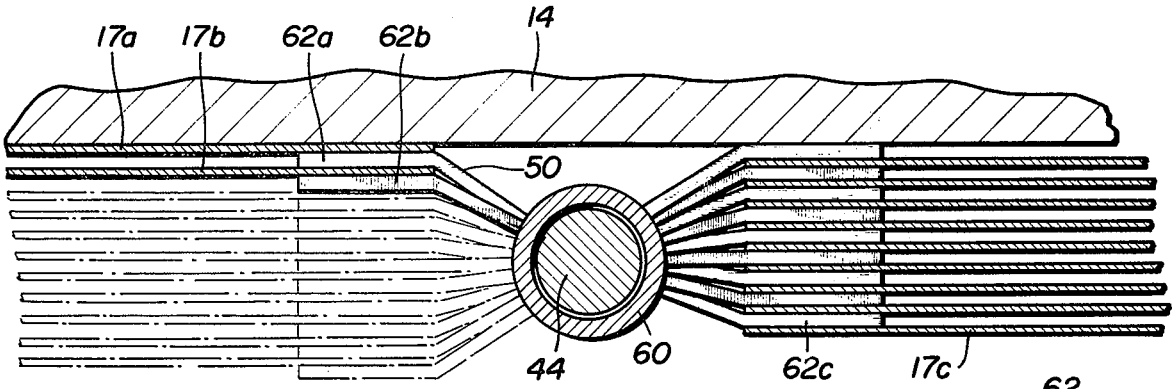
FIG.9
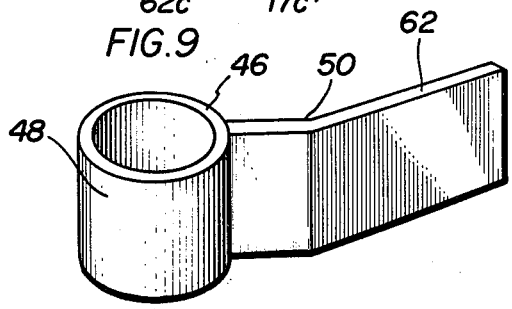
FIG.6
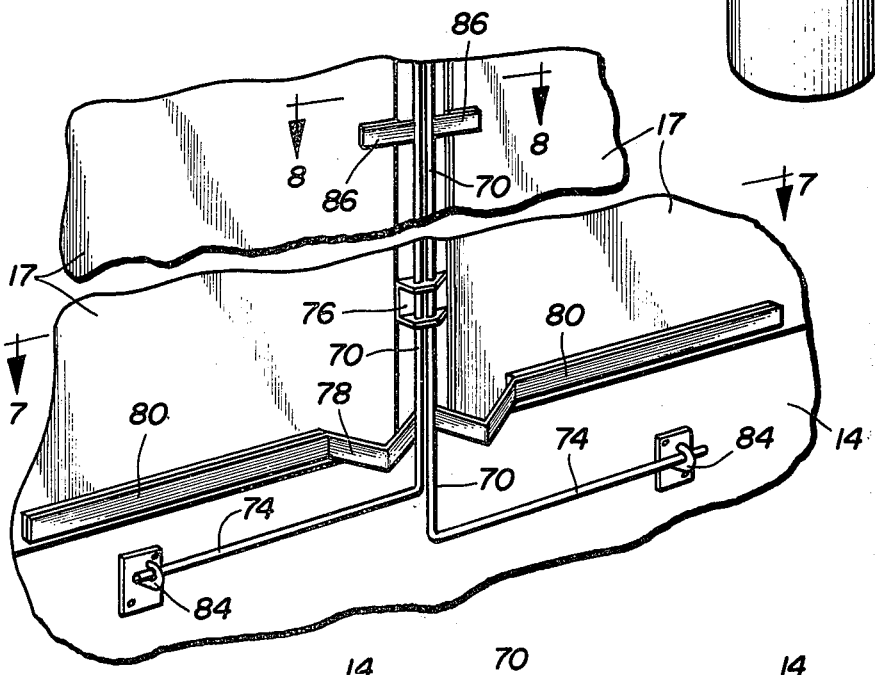
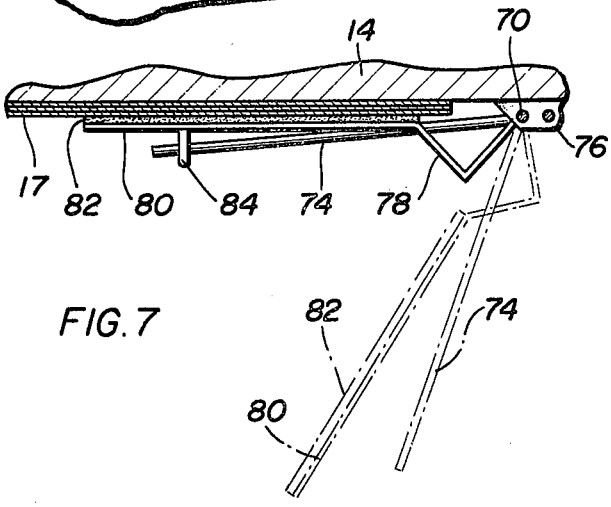
FIG.7
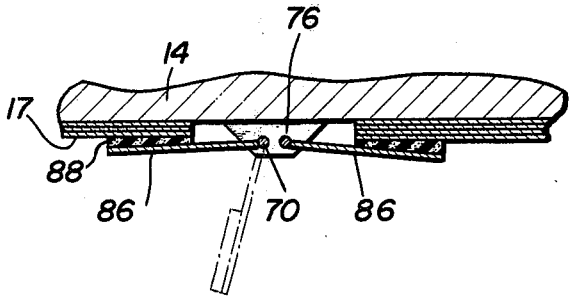
FIG.8

CHANGEABLE DISPLAY APPARATUS

This invention relates to changeable copyboard displays and particularly to an improved structure especially useful for readily changing various sizes of alphanumeric characters such as on billboards and other types of displays.

Changeable copyboard displays are used extensively, particularly along interstate highways. At many of such display locations, it is desirable to be able to change the alphabetical or numerical characters displayed so as to reflect current or updated information. As an example, changeable copyboards displaying the price of gasoline per gallon are normally changed by replacing the old numerals with the new numerals so as to reflect a change in the price of gasoline per gallon. The procedure usually requires an individual selecting the numerals from storage, taking the new numerals to the copyboard site, removing the old numeral from the copyboard background, and mounting the new numeral thereon. In some instances where the copyboard frames are quite large in size, it is required that the individual climb a ladder to get to the top of the frame for replacement of the numerals. Such an operation is of course time consuming, cumbersome, and in the event of high winds, can place an individual in danger of suffering personal injury during the display changing procedure.

It is therefore desirable to provide a changeable copyboard display which can readily be changed, which feature is particularly useful in the case of large size copyboard displays.

SUMMARY OF THE INVENTION

A changeable display apparatus is provided for mounting on a copyboard background or frame. The changeable display apparatus includes a plurality of segmented display characters wherein each of the character segments are hingedly supported in a flat, compact manner on the frame. The changeable display apparatus further includes clamping means operable between a clamped display position wherein each of the character segments are maintained substantially flat against the frame and a changing display position wherein the clamping means are unsecured from the character segments so that the display can be changed. More particularly, each of the display character segments is mounted to a respective flanged hinge members — the hinge members each having a flange angled so as to take into account the thickness of each character segment and enable the plurality of character segments to lie substantially flat against the display frame at all times other than during changing of the display.

One of the most significant advantages of the present invention is that the display characters are self stored directly on the copyboard frame itself, eliminating any necessity to provide additional storage space for the display characters. Another significant advantage of this invention is that the display can readily be changed by unclamping the apparatus and hingedly rotating the display character segments until the desired display is obtained, and then locking or clamping the character segments in position.

BRIEF DESCRIPTION OF THE DRAWING

FIG. 1 is a perspective view illustrating a changeable segmented character display apparatus constructed in accordance with the principles of the present invention;

FIG. 2 is a front elevational view illustrating the details of segmented display character supported by rotatable hinged members and maintained in position by selective clamping means;

FIG. 3 is a front elevational view similar to FIG. 2 but illustrating a different segmented display character;

FIG. 4 is a partial sectional view taken along section line 4—4 of FIG. 2 showing the rotatable mounting details for the hinged members;

FIG. 5 is a partial sectional view taken along section line 5—5 of FIG. 4 showing a plurality of rotatable hinge members each having a respectively angled flange portion so that the segmented display characters are enabled to lie substantially flat against the display frame;

FIG. 6 is a partial perspective view illustrating the clamping means for selectively maintaining the segmented display characters in a clamped position;

FIG. 7 is a partial sectional view taken along section lines 7—7 in FIG. 6 illustrating in solid lines the position of the clamp in the clamped position and in dashed lines in the released position during changing of the display;

FIG. 8 is a partial sectional view taken along section lines 8—8 of FIG. 6 illustrating the hold down tabs mounted to the clamp rod for holding the segmented display characters in the clamped position, and illustrating in dashed lines the released position during release and rotation of the clamp rod; and FIG. 9 is a perspective view illustrating one of the hinge members showing the associated angled flange portion for positioning the character segments flat against the display frame.

DETAILED DESCRIPTION

Referring now to FIG. 1, there is illustrated a changeable copyboard or billboard 10 which incorporates a changeable display assembly 12 in accordance with the principles of the present invention. It is to be understood that this description of the invention in connection with large size displays is only for purposes of illustration of an embodiment thereof and that the invention can apply as well to small size displays, such as used with point of purchase advertising. The changeable display apparatus 12 is mounted on a frame 14 which in turn is supported by posts 16 or any other suitable support means to provide a display of a plurality of character segments 17.

The remaining FIGS. 2–9 illustrate the construction details of the changeable display apparatus 12. In particular, FIG. 2 shows a respective segmented character, including respective half segments 18 and 20 which when combined display the numeral "8". As can be seen from FIG. 2, half of the numeral "8" is screen printed or otherwise placed on the respective half segments 18, 20. FIG. 3 illustrates the numeral "7" formed by respective segment portions 22, 24 each containing one half of the numeral "7". The segmented display characters are hingedly mounted on the frame 14 so that the half segment 24 of character "7" is the reverse side of the half segment 18 of the numeral "8". Each of the half character segments can be constructed of aluminum, acrylic or wood members on which the numerals themselves may be screen printed or otherwise mounted or placed directly thereon.

Referring now to FIG. 4, there is illustrated a hinge assembly 26 mounted to the frame 14 enabling the display characters to be readily changed as desired. As is illustrated in FIG. 4, a top bracket 28 and a lower bracket 30 are mounted by means of suitable bolts and nuts 32, 34 to the frame 14. The horizontal portion of respective brackets 28, 30 each contains an aperture for enabling respective threaded ends 36, 38 or rod 44 to pass therethrough. Bolts 40, 42 maintain the rod 44 rigidly mounted on the brackets 28, 30.

Mounted on the rod 44 and between brackets 28 and 30 is a plurality of flanged hinge members 46 (see FIG. 9) each having a cylindrical portion 48 and a respective angled flange portion 50 extending therefrom. As shown in FIGS. 2 and 3, there is a first set 52, a second set 54 and a third set 56 of respective flanged hinge members 46 mounted on the support rod 44. A spacer cylinder 58 is mounted on rod 44 between hinge member sets 52 and 54 and a second cylinder spacer 60 is mounted on rod 44 between hinge member sets 54 and 56. Each of the hinge member sets 52, 54 and 56 are identical with each other, however, within each set each hinged member 46 contains a different angled flange portion 50 and flange extension 62. This can be seen most clearly with reference to FIG. 5 which is a cross sectional view taken along the section lines 5—5 of FIG. 4. A flange extension 62 extending from the angled flange portion 50 of each of the hinged members 46 is mounted to a respective character segment 17 as shown in FIG. 5. As noted therein, flange extension 62*a* is cemented or otherwise secured to the first segmented character 17*a;* extension 62*b* is secured to character segment 17*b;* extension 62*c* is secured to character segment 17*c;* etc. The identical hinge member 46 in the sets 52 and 54 are also secured to the respective character segments so that each character segment is attached to at least one hinge member in each of the sets 52, 54 and 56. For small displays only one set of hinge members, such as 52, may be required to support small character segments.

It is to be particularly noted from FIG. 5 that the angled flange portions 50 and extensions 62 of each of the hinge members 46 is constructed such that the character segments are supported by the hinge members 46 to lie substantially flat against the frame 14 on either side of the hinge assembly 26. The dashed lines in FIG. 5 illustrate the positions taken by the hinge members and associated character segments when they are rotated clockwise on rod 44 from the right hand side of the hinge assembly in FIG. 5 to that shown in the dashed lines on the left side of the hinge assembly.

In particular, in the embodiment illustrated herein the character segments lie substantially flat against each other on the frame 14. As noted in FIG. 5, this is provided by the flange portion 50 being radially aligned in each distance with the cylindrical portion 48 of each hinge member and the flange extensions 62 extending from a point on respective radial flange portions 50 to take into account the width or thickness of each of the display character segments 17. That is, with reference to FIG. 5, for thicker character segments the flange extensions 62 could start at radial points on each flange portion 50 closer to the center of the cylinder 48; whereas, for thinner character segments the extensions 62 could start at radial points farther from the center to enable the character segments to lie flat against each other. In some cases the flange extensions 62 could be attached directly onto the cylindrical portion 48 at a radial point on the perimeter thereof. In any event, the illustration shows the preferred embodiment of the invention and variations thereof may be readily made in accordance with the teaching herein.

With reference to FIGS. 2, 3 and 6–8, there is illustrated the clamping means for releasably securing the character segments on the frame. In particular, at the free or rotating end of the character segments 17, there is provided a vertical rod 70 with one end secured by a bracket 72 to the frame and another end terminating in a horizontal rod portion 74. The vertical rod 70 is also supported on the frame 14 by means of intermediate brackets 76. At both the top and bottom of the vertical rods 70 there is attached a hold down clamp 78 having a V-shaped portion welded or otherwise secured to the rod 70 and a flat longitudinal portion 80 with a resilient pad 82 mounted on the side facing the character segments 17.

FIG. 7 illustrates the clamp in the clamped position in solid lines and in the released position in dashed lines for changing of the display. In the released position shown in dashed lines of FIG. 7, the rod 70 is rotated by first unhooking the horizontal portion 74 from the latching member 84. With respect to FIG. 7, the horizontal rod portion 74 is then rotated counterclockwise so as to release the arm 80 and the resilient pad 82 from the character segment 17. A pair of intermediate hold down tabs 86 (see FIG. 8) is mounted at one end to the rod 70 and contains at the other end thereof a pad of resilient material 88 on the side facing the character segment 17. The dashed line portion of FIG. 8 illustrates the position of the tab 86 and resilient pad 88 when the clamping means are in the released position during display changes. It is understood, of course, that the clamping arms 80 and clamping tabs 86 maintain the character segments substantially flat on the frame and prevent the character segments from undesired movement on the frame during high wind conditions. Release of the horizontal rod 74 from the latching member 84 and rotation of the rod 70 by moving the arm 74 so as to remove the clamping arms 80 and tabs 86 away from the surfaces of the character segment 17 enables the display segments to be hingedly rotated so that the desired display is presented.

As an example, if it is desired to change one of the characters from displaying the numeral "7" as shown in FIG. 3 to subsequently display the numeral "8" as shown in FIG. 2, the following sequence is performed by the operator. Horizontal rod arm 74 is unhooked from the latching member 84 and rotated in a counterclockwise manner (as shown in FIG. 7, for instance). The half character segment 24 is then hingedly rotated so as to be superimposed over the half segment 22, thereby providing the display of the numeral "8" as shown in FIG. 2. The horizontal arm 74 is then rotated towards the latching member 84 and secured therein so that the clamping arms 80 and tabs 86 are firmly urged down onto the surface of the respective character segment. It may be noted with reference to FIG. 7 that the V-shaped portion 78 of the upper and lower clamping members provides some springingness in the clamping arm 80 such that as the horizontal rod arm 74 is rotated towards the character segments 17, the resilient pad 82 contacts the front side of the character segment 17 just prior to the end of rod 74 being secured into the latch member 84. The continued rotation of rod 74 to bring it into a latching and clamping position with latching member 84 as shown in FIG. 6 thereby firmly urges the resilient pad 82 against the character segment and assures a firm clamp on the character segments. At the same time, the pads 88 on the tabs 86 are firmly urged in a clamping position on the character segments at points intermediate the upper and lower clamping arms 80.

The foregoing detailed description has been given for clearness of understanding only, and no unnecessary limitations should be understood therefrom, as modifications will be obvious to those skilled in the art.

What is claimed is:

1. Changeable display apparatus comprising:

a frame;

a plurality of substantially flat display character members;

a hinge assembly rigidly mounted to one end of said display character members;

means for mounting said hinge assembly to said frame for changeably displaying said display characters thereon;

said hinge assembly including, a rod;

a plurality of hollow cylindrical members rotatably mounted immediately adjacent each other on said rod;

a plurality of flanges having one end extending respectively from the perimeter of each of said cylindrical members;

a mounting portion extending outwardly from the other end of each of said flanges;

means for mounting a respective one of said display character members to each of said mounting portions;

said mounting portions of each of said flanges disposed substantially parallel to each other on said rod so that said display character members mounted thereto lie substantially flat on said frame;

latching means mounted on said frame for selectively unlatching and rotating desired display character members on said hinge assembly for changing said display and for clamping said display characters in display position on said frame;

said latching means including a pair of latching arms pivotally mounted to said frame on each side of said hinge assembly and immediately adjacent the other end of said display character members for urging said display character members against said frame, and means for selectively clamping said latching arms to said frame to maintain said display character members in display position on said frame; and a pair of latching tabs pivotally mounted on said frame on each side of said hinge assembly intermediate said respective latching arms, and means for respectively simultaneously pivoting respective pairs of said latching arms and tabs during changing of said display.

2. A changeable display as claimed in claim 1, wherein said latching arms include a tensioning portion so that said latching arms and said latching tabs contact said display character members immediately prior to clamping of said latching arms on said frame.

3. A changeable display as claimed in claim 6, wherein said latching means further includes resilient pads secured to said latching arms for selectively contacting said display character members and urging them against said frame in said display position.

4. A changeable display as claimed in claim 2, wherein each of said display character members includes a half segment character such that two adjacent display character members in said display position form a display character.

5. A changeable display as claimed in claim 4, wherein each of said display character members includes a half segmented character on each side thereof.

6. A changeable display as claimed in claim 5, wherein each of said display character members includes a half numeral on each side thereof.

* * * * *